United States Patent [19]

Van den Beld et al.

[11] B 3,990,628

[45] Nov. 9, 1976

[54] PLASTIC BAG WITH ZIG ZAG PLIES

[75] Inventors: Paul Christiaan Herman Van den Beld; Robert Jan Hoogenboom, both of Hardenberg; Willem Zweers, Coevorden, all of Netherlands

[73] Assignee: Wavin B.V., Zwolle, Netherlands

[22] Filed: Dec. 28, 1973

[21] Appl. No.: 429,157

[44] Published under the second Trial Voluntary Protest Program on January 27, 1976 as document No. B 429,157.

[30] Foreign Application Priority Data

Jan. 6, 1973 Netherlands ..... 7300211

[52] U.S. Cl. ..... 229/62.5

[51] Int. Cl.[2] ..... B65D 31/14

[58] Field of Search ..... 229/62.5; 150/9

[56] References Cited

UNITED STATES PATENTS

| | | | |
|---|---|---|---|
| 1,819,425 | 8/1931 | Kronmiller | 229/62.5 |
| 2,340,546 | 2/1944 | Meaker | 229/62.5 X |
| 2,959,343 | 11/1960 | Rosander | 229/62.5 |
| 3,004,698 | 10/1961 | Ashton | 229/62.5 |
| 3,167,241 | 1/1965 | Woerner | 229/62.5 |

*Primary Examiner*—William Price
*Assistant Examiner*—Stephen P. Garbe
*Attorney, Agent, or Firm*—Edmund M. Jaskiewicz

[57] ABSTRACT

A plastic bag with zig zag plies provided with a tubular valve foil sealed on the one hand to an outwardly folded tubular foil part originally situated between two incisions along zig zag ply edges and on the other hand to an end seal of the tubular foil and at last to the tubular foil by a seal extending between the end points of the said incisions and said end seal.

The plastic bag may be provided with an outer lining or covering bag for protecting the bag. The covering bag is provided with an opening for passage of the tubular valve foil.

10 Claims, 7 Drawing Figures

PLASTIC BAG WITH ZIG ZAG PLIES

BACKGROUND OF THE INVENTION

The invention relates to a synthetic bag with zig zag plies along the longitudinal sides, comprising a central and two outer zig zag ply longitudinal edges which define a first and a second zig zag plied part, the bag also having a filling valve on at least one of the final transverse sealed joints of the tubular foil constituting the bag.

Such a bag of synthetic material with zig zag plies and filling valve is known per se. This known synthetic bag has the drawback that this type of bag can only be used with difficulty which both filling machines with a vertical filling mouth and machines with a horizontal filling mouth. It is however desired in practice to utilize both types of filling machines. Therefore, after filling by means of e.g. a filling machine with a vertical filling mouth the entire valve should easily assume its original position, i.e. a position beside the final transverse sealed joint. This takes a certain retractive force, or a force exerted on the return valve.

SUMMARY OF THE INVENTION

The object of the invention is to provide a solution for this problem. This is attained by the arrangement that in flat condition of the bag, from the free end of the tubular foil with longitudinally extending zig zag ply edges a first and a second zig zag plied part are each provided with a longitudinal incision. A tubular valve foil forming a valve is sealed to the outwardly folded tubular foil part, between the aforementioned incisions, by means of a first valve sealed joint which extends in the vicinity of the outer zig zag ply edges, preferably just beyond them, between the end points of the incisions, and to the marginal parts of the tubular foil walls, formed by the incisions and by means of a second valve sealed joint extending between the end points of the incision as seen in the direction of the final transverse sealed joint which closes the tubular foil.

In such a bag the tubular valve foil returns easily to its original condition owing to the upwards pushing force exerted by the tubular foil as a consequence of the particular way in which the sealed joints are formed, when the starting material is a zig zag plied tubular foil.

In a particularly advantageous way the incisions extend in the area between the end of the produced part of the central zig zag ply edge, which end is connected with the transverse sealed joint, and the two outer zig zag ply edges toward the outer zig zag ply edges, whereby the part beside the incision is recovered as waste. The incision extends between the imaginary intersection of the final transverse sealed joint and the produced part of the central zig zag ply line and the outer zig zag ply lines situated closest thereto. The second valve sealed joint extending between the end point of the incision and the final transverse joint thus exerts a retractive force on the tubular foil, when the latter is connected to a filling machine with vertical filling mouth and the deformation of the tubular valve foil is canceled.

According to another suggestion, the tubular foil valve is connected by at least one spot — or line-shaped sealed joint, except for auxiliary sealed joints extending parallel to the transverse sealed joint or coinciding therewith, with the tubular foil in the area situated beyond the first and second valve sealed joint, such that the valve tubular foil part situated in the bag remains pivotally connected with the wall of the bag.

SURVEY OF THE DRAWINGS

Figure 1:
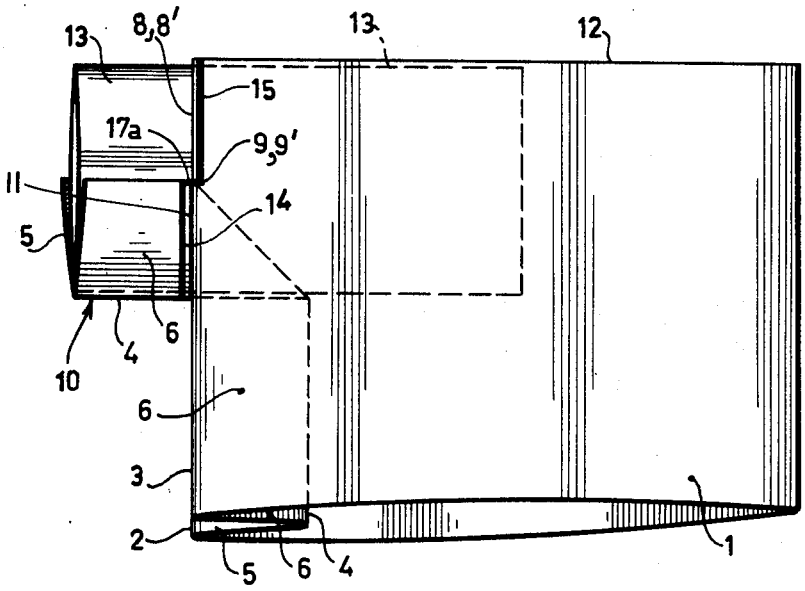
FIG. 1 shows a first embodiment of a bag made of synthetic material according to the invention.

DESCRIPTION OF PREFERRED EMBODIMENTS:

FIG. 1 represents a flattened tubular foil 1 comprising two outer zig zag ply edges 2 and 3 and a central zig zag ply edge 4. The central zig zag ply line 4 and the imaginary lines 4', 4'' on the outside of the tubular foil extending parallel thereto, define the first zig zag plied part 5 and the second zig zag plied part 6.

The zig zag ply edges 2 and 3 are both incised by incisions 8 and 8' as far as the end points 9 and 9'. The part situated between incisions 8 and 8' is plied according to the connecting line 11 between the end points 9 and 9' of the incisions and constitutes the plied part 10.

Thereupon a tubular valve foil 13 is inserted into the opening between the transverse end sealed joint 12 of the bag and the ply line 11 of the plied part 13,. A first valve sealed joint 14 is formed just beside and outside the zig zag ply lines 2 and 3. The first valve sealed joint 14 extends between the incision end points 9, 9' in the part of the tubular valve foil 13, located farthest from the transverse final sealed joint 12.

The second valve sealed joint 15 extends from the area in the proximity of the end points 9 and 9' of the incisions to the final transverse sealed joint 12. The second valve sealed joint 15 connects the tubular valve foil 13 with the marginal portions of the tubular foil, the marginal portions being situated beside the edges of the incisions 8, 8'.

As can be seen the tubular valve foil 13 is exclusively connected via a first and a second valve sealed joint with the bag made of synthetic material. In order to obtain a proper sealing another connecting sealed joint 17*a* may be formed between the first sealed joint 14 and the second sealed joint 15 in the vicinity of the end points 9, 9' of the incisions.

As is shown the tubular valve foil 13 is received in the bag in such a way that it is entirely freely supported. Due to the way in which the tubular valve foil is connected, however, the same will, when disposed on a filling machine with a vertical filling pipe, after filling, assume its original position, on account of a pull exerted by the foil part beside the second valve sealed joint.

Figure 2:
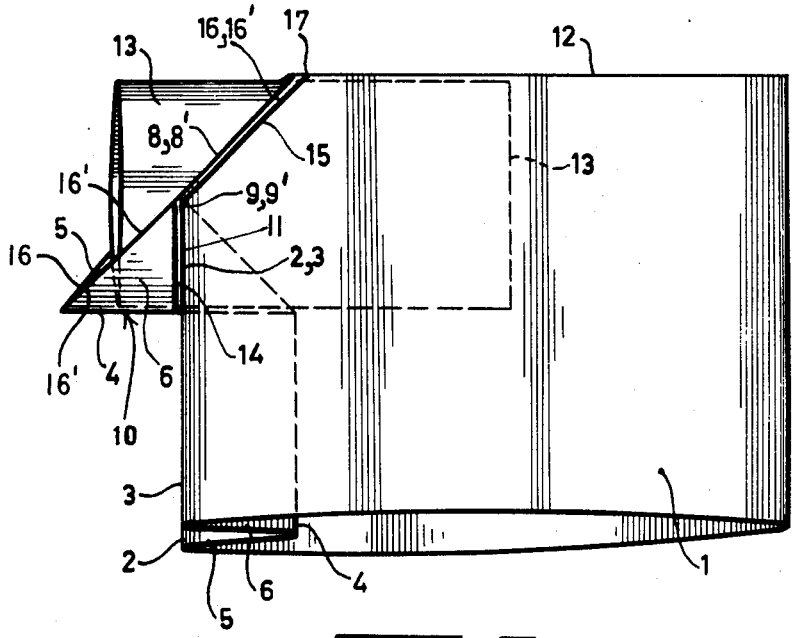
FIG. 2 is a second embodiment.

In FIG. 2 is shown another embodiment in which, however, the incisions 16, 16' in the first and second zig-zag plied parts 5 and 6 are no longer provided by incising the zig zag ply edges 2 and 3, but extend from the end transverse sealed joint 12 to a point situated on the outer zig zag ply edges 2 and 3. The portion of the tubular foil 1 situated outside these incisions is removed as waste.

Similar to FIG. 1, a tubular valve foil 13 is introduced into the tubular foil 1, whereupon the first valve sealed joint 14 is formed in the same way as in the embodiment according to FIG. 1, but the second valve sealed joint 15 extends now between the end points 9 and 9' of the incisions and a point 17 on the transverse sealed joint. This point 17 on the transverse sealed joint is preferably in line with the central zig zag ply edge 4.

With such an embodiment a still better return of the foil to its original position is obtained.

Obviously it is not obligatory to align point 17 with central zig zag ply edge 4, as this point may also be situated somewhere between the two outer zig zag ply edges 2 or 3 and the central edge 4.

In this embodiment the part 10 which is folded outwardly as shown in FIG. 2 constitutes in the flattened condition of the bag a triangular part which may be used for closing the tubular valve foil. This will occur when in the filled bag the free end of part 10 is folded inwardly of the tubular foil part, situated beside the second valve sealed joint.

Figure 3:
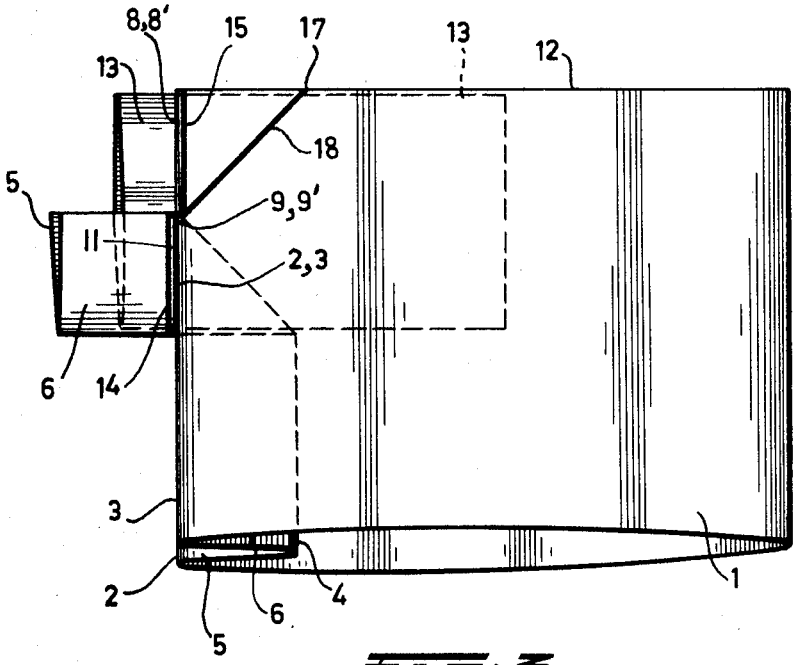
FIG. 3 is a third embodiment in which the bag is still shown in the flattened condition.

A very particular and preferably used embodiment is shown in FIG. 3, which corresponds with the embodiment according to FIG. 1. In this case, however, an auxiliary sealed joint 18 is formed between the transverse end sealed joint 12 and the end points 9 and 9' of the incisions. The end point of the auxiliary sealed joint 18 situated on the transverse final sealed joint 12 lies preferably between the extended part of the central zig zag ply edge 4 and the outer zig zag ply edges 2 and 3 and very efficiently on the extended part of the central zig zag ply edge 4 at the location where the same intersects the final transverse sealed joint 12.

Instead of the auxiliary sealed line-shaped connection 18 one can also use a single spot-sealed joint 18. In this case, too, the spot-sealed joint is positioned between the outer zig zag ply lines 2, 3 and the ply line 4.

Figure 4:
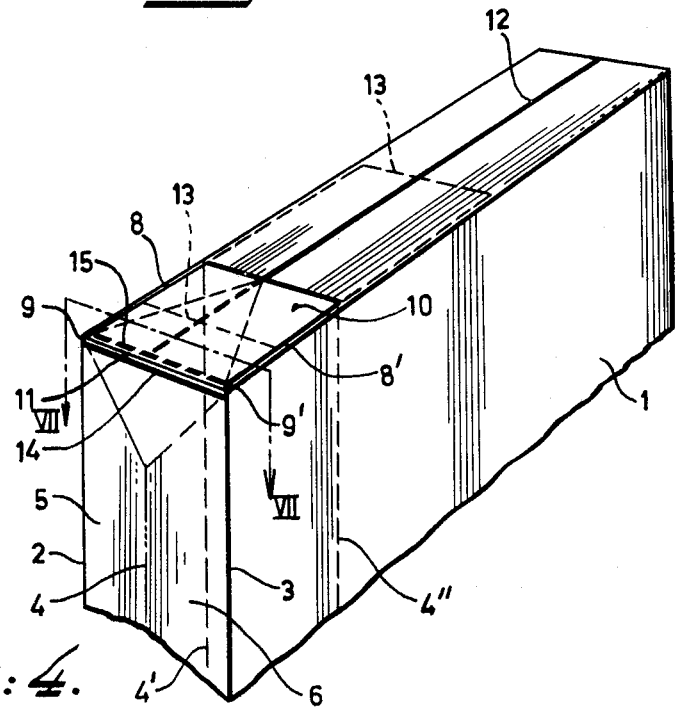
FIG. 4 shows a perspective view of the upper end of the bag after filling.

Part 10 folded outwards about the fold line 11 can in this case conveniently serve for closing the tubular valve foil 13, since after filling the bag this part 10, can be folded again on the outside of the bag as represented in FIG. 4. Since this folded part never contacts the filling material, it may conveniently be glued to the outside of the bag.

It is obvious that in the plastic bag according to the invention a considerable part of the end of the tubular valve foil should at any rate be clear of the bag after formation of the auxiliary sealed joints.

The end of the tubular valve foil may be provided with incisions in order to improve the sealing.

Figure 5:
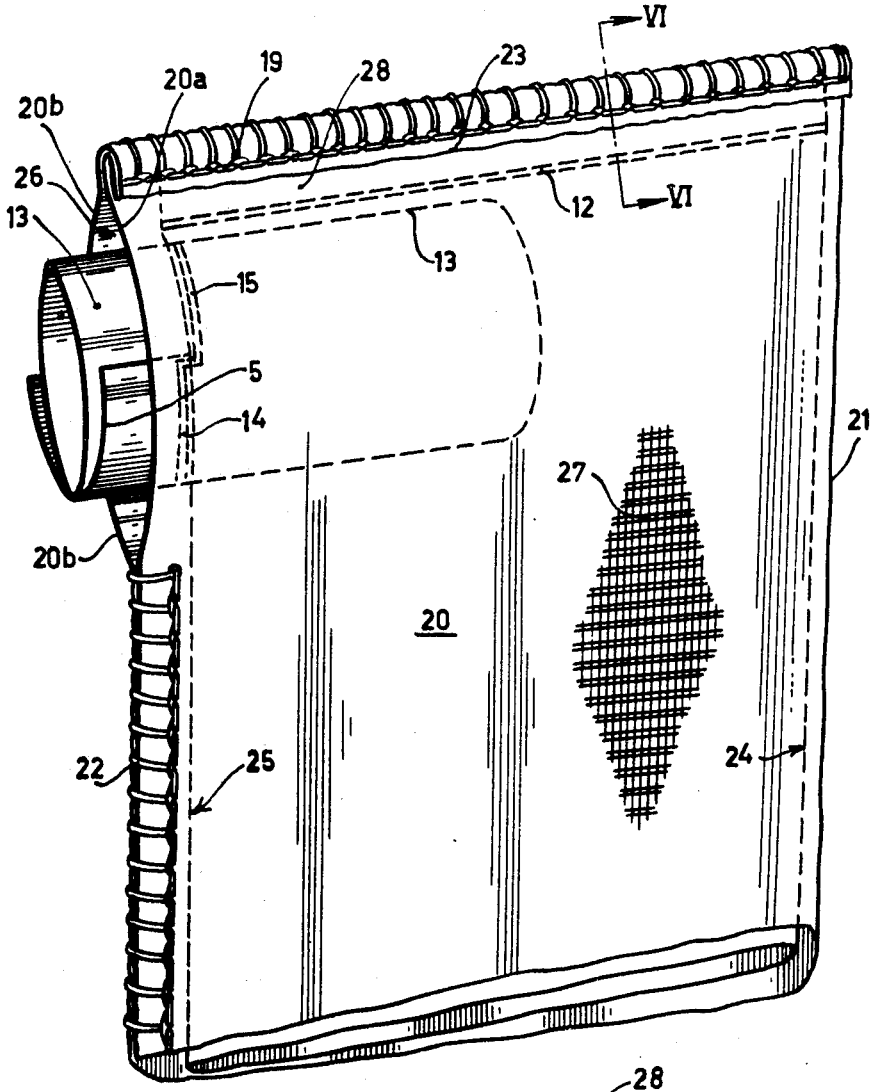
FIG. 5 shows a perspective view of a bag in an outer cover.
Figure 6:
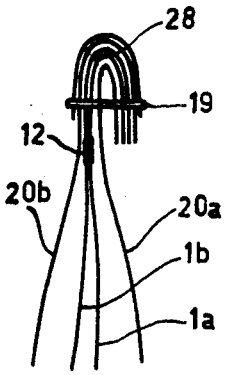
FIG. 6 shows a section according to line VI—VI in FIG. 5.
Figure 7:
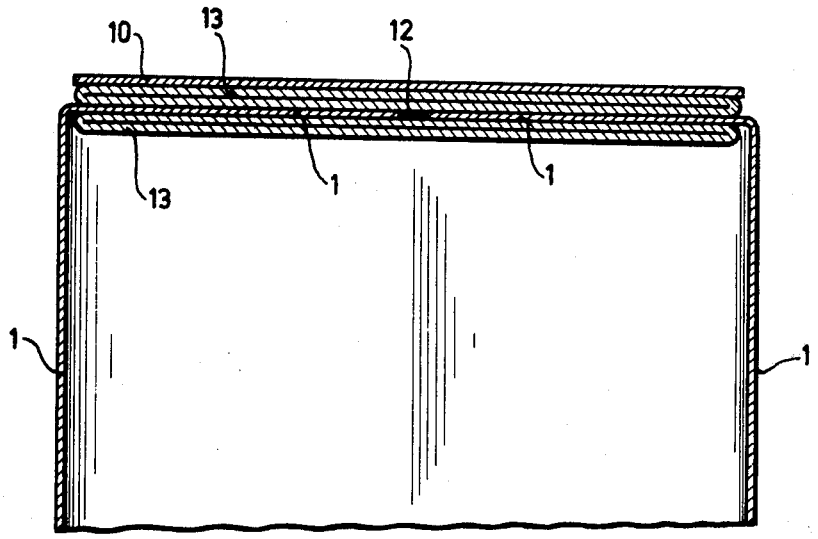
FIG. 7 shows a section according to line VII—VII in FIG. 4 — was inserted between lines 4 and 5.

FIGS. 5 and 6 show a composite bag comprising a plastic bag 1 with zig zag plies according to the invention and an outer covering bag 20. The covering bag 20 may consist of jute or of a woven thermoplastic sheet material.

FIG. 5 shows a part 27 of a woven material manufactured by interweaving polypropylene filament. The covering bag 20 may be manufactured by connecting the edges 21 and 22 of two superposed jute layers or layers of woven material 20*a*, 20*b* by stitching. The bottom edge (not shown) is obtained in the same way. The outer edges 21 and 25 of the bag 1 and the bottom edge (not shown) are not connected with the outer covering bag 20.

The outer covering bag 20 is provided with an opening 26 for passing the tubular valve foil 13 of the bag 20 through said opening 26.

For connecting covering bag 20 and plastic bag 1, plastic bag 1 is provided with an edge part 18 extending beyond end seal 12. After folding edge part 18 with the layers 20*a*, 20*b*, the different superposed layers are interconnected by means of stitches 19. In this way bag 1 is connected with bag 20. Numeral 23 indicates the free ends of the layers 20*a* and 20*b*.

According to a preferred embodiment the covering outer bag 20 is also constructed as a block bag such that the filled composite bag has a block bag shape.

It will be understood that this invention is susceptible to modifications in order to adapt it to different usages and conditions, and accordingly, it is desired to comprehend such modifications within this invention as may fall within the scope of the appended claims.

What we claim is:

1. A plastic bag obtained from a tubular foil and having in the flattened condition longitudinal edges, there being an inward fold (4) along one longitudinal edge to define first and second longitudinal plies (5,6) having ply longitudinal edges (2,3), a transverse sealed joint (12) on said tubular foil to define an end of the bag, there being first and second longitudinal incisions (8,8') in said plies (5,6) said incisions extending from said bag end and terminating at respective incision end points (9,9') on said longitudinal ply edges (2,3) to define a foil flap (10), said foil flap (10) being folded outwardly and a tubular filling valve (13) inserted in the opening defined by said outwardly folded foil flap, a first sealed joint (14) extending from said end points in a direction away from said bag end transverse sealed joint to connect said foil flap with said tubular filling valve, and a second sealed joint (15) from said end points extending to said end transverse joint connecting said tubular filling valve to the edges of said foil adjacent said incisions to close the tubular foil.

2. A plastic bag as claimed in claim 1 wherein said first sealed joint (14) is outwardly of said ply longitudinal edges (2,3).

3. A plastic bag as claimed in claim 1 wherein said incisions (16,16') in said longitudinal plies (5,6) extend from a point on said transverse joint (12) at the intersection of an extension of said inward fold (4) therewith to the respective ply longitudinal edges (2,3).

4. A plastic bag as claimed in claim 1 wherein said incisions (8,8') are along said longitudinal ply edges (2,3).

5. A plastic bag as claimed in claim 4 and a third sealed joint extending from said incision end points (9,9') to a point on said transverse seal (12) at the intersection of an extension of said inward fold (4).

6. A plastic bag as claimed in claim 1 and a third sealed joint (18) extending from the area of said first and second joints to said transverse seal (12) to connect said tubular filling valve with said tubular foil such that the portion of said tubular filling valve within said bag is pivotally connected with the wall thereof.

7. Plastic bag according to claim 1 wherein an outer covering bag is positioned around the outside of the bag with zig zag plies and the tubular valve of said last mentioned bag is passed through an opening in the outer covering bag.

8. Plastic bag according to claim 7 wherein the covering bag forms a block bag after filling of the plastic bag.

9. Plastic bag according to claim 7, wherein an edge extending outside the transverse end seal of said tubular foil is connected with the upper edge of the outer covering bag.

10. Plastic bag according to claim 9, wherein the edge extending outside the end seal is connected with the covering bag by stitches forming the end closure of the covering bag.

* * * * *